US005915437A

United States Patent [19]

Petner

[11] Patent Number: 5,915,437

[45] Date of Patent: Jun. 29, 1999

[54] MOP BONNET CLIP

[75] Inventor: Robert E. Petner, Burlington, N.J.

[73] Assignee: Quickie Manufacturing Corp.

[21] Appl. No.: 09/050,925

[22] Filed: Mar. 31, 1998

[51] Int. Cl.[6] ..... A47L 13/20

[52] U.S. Cl. ..... 15/228; 15/147.1; 15/231

[58] Field of Search ..... 15/147.1, 150, 15/228, 231, 232, 247

[56] References Cited

U.S. PATENT DOCUMENTS

| | | | |
|---|---|---|---|
| 1,983,363 | 12/1934 | Glover | 15/231 |
| 2,440,014 | 4/1948 | Ludwick | 15/231 |
| 4,715,081 | 12/1987 | Welch | 15/229.8 |
| 4,962,563 | 10/1990 | Bachar | 15/228 X |
| 5,165,136 | 11/1992 | Moore | 15/229.4 |
| 5,461,749 | 10/1995 | Ahlberg et al. | 15/228 |
| 5,477,582 | 12/1995 | Yamashita | 15/231 |

*Primary Examiner*—Mark Spisich
*Attorney, Agent, or Firm*—Stuart M. Goldstein, Esq.

[57] ABSTRACT

Dual bonnet clips, preferably of integral plastic molded construction, are secured to the top surface of the head of a dust type mop. Each clip has two resilient upstanding arms which, when pushed down at their respective ends, causes the side sections of the clip to pivot up from the top surface of the mop at the clips' midpoint. In this raised position, the side surfaces of the mop's bonnet can be placed under the side sections. When the downward pressure on the ends of the arms is released, the side sections of the clips pivot down and lower onto the bonnet, securing the bonnet to the mop head.

7 Claims, 3 Drawing Sheets

MOP BONNET CLIP

BACKGROUND OF THE INVENTION

Dust type mops have been used as a popular and efficient cleaning tool for many years. One form of dust mop employs a solid cleaning head member connected to a mop handle. The mop head is used to clean, polish, or dust floor, wall or similar surfaces. Routinely a separate removable fabric or sheet or covering also known as a bonnet surrounds the head member and is actually the mop surface which engages the area to be treated. Such removable covering bonnets allow the mop to enjoy a variety of different uses, i.e. dusting, polishing, buffing, sanding, with different types of bonnet materials. In addition, when one bonnet becomes soiled or wears out, it can easily be replaced.

A problem with the use of such bonnets results from the difficulty of securing the bonnets to the head during use. As the mop is run back and forth over a surface, the bonnet tends to come loose and fall off. Existing bonnet attachment devices have not provided an effective means of ensuring that the bonnet remains secure in position on the head during use—while also providing a simple and easy means to attach, remove and reattach the bonnet.

SUMMARY OF THE INVENTION

It is thus the object of the present invention to overcome the limitations and disadvantages of prior mop bonnet attachment means.

It is the object of the present invention to provide a dust mop with a simple and convenient means to attach, remove and reattach a mop bonnet.

It is a further object of the present invention to provide a mop with bonnet clips which provide a simple and quick means to attach a bonnet to the mop.

It is still another object to the present invention to provide bonnet clips for a mop which are integral, unitary pieces which are easily manufactured and secured to the mop.

It is a further object of the present invention to provide bonnet clips simple in design for ease of attachment onto a mop.

It is still a further object of the present invention to provide bonnet clips for a mop which are sturdy for long life and are reliable in securing different varieties of bonnets.

The present invention comprises dual bonnet clips, preferably of integral plastic molded construction, which are secured at their respective midpoints to the top surface of the head of a dust type mop. Each clip has two resilient upstanding arms which, when pushed down at their respective ends, causes the side sections of the clip to pivot up from the top surface of the mop at the clips' midpoint. In this raised position, the surface surfaces of the mop's bonnet can be placed under the side sections. When the downward pressure on the ends of the arms is released, the side sections of the clips pivot down and lower onto the bonnet, securing the bonnet to the mop head.

The novel features which are considered as characteristic of the invention are set forth in particular in the appended claims. The invention, itself, however, both as to its design, construction, and use, together with additional features and advantages thereof, are best understood upon review of the following detailed description with reference to the accompanying drawings.

DETAILED DESCRIPTION OF THE INVENTION

Figure 1:
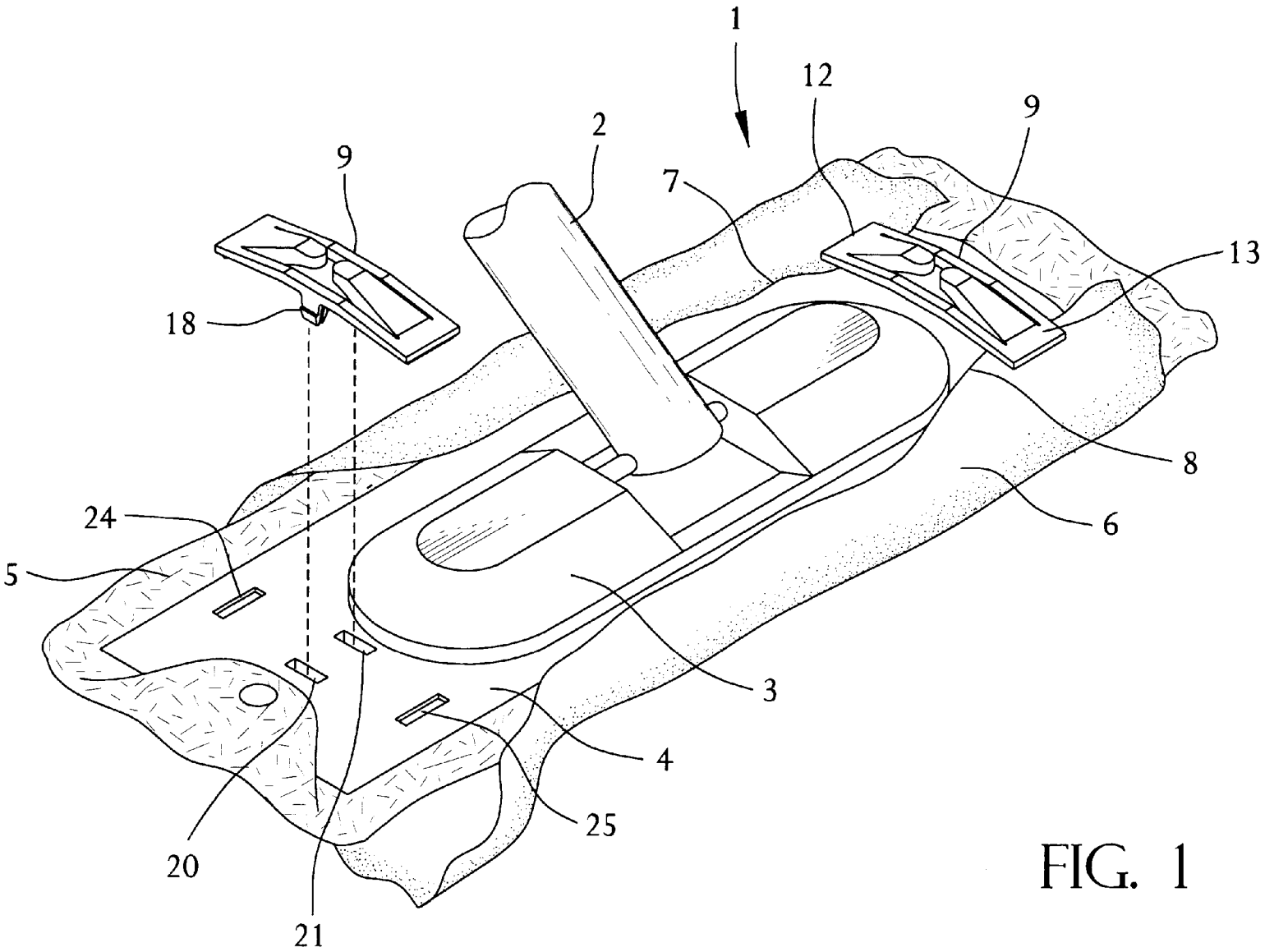
FIG. 1 is an isometric view of a mop employing the bonnet clips of the invention.
Figure 2:
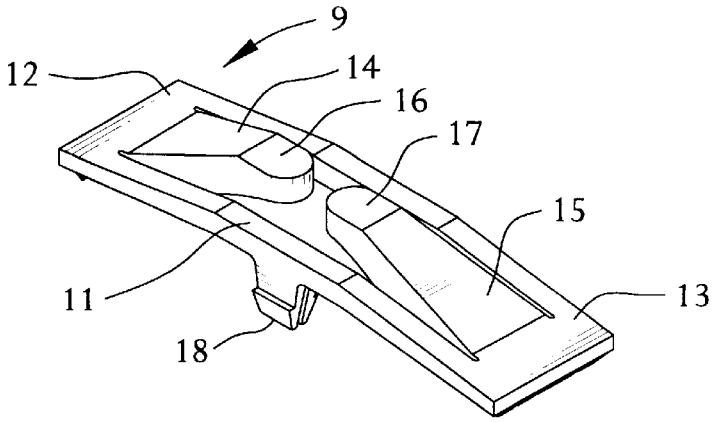
FIG. 2 is an isometric view of the bonnet clip of the invention.
Figure 3:
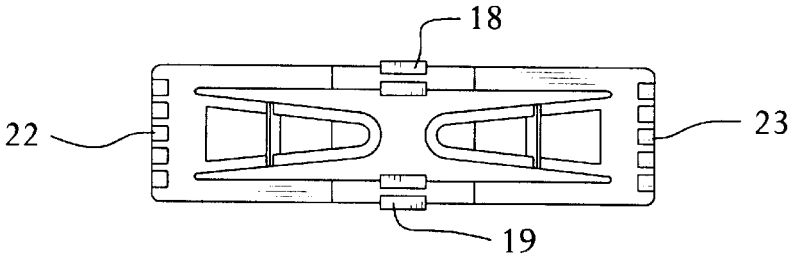
FIG. 3 is a bottom view of the bonnet clip of the invention.
Figure 4:
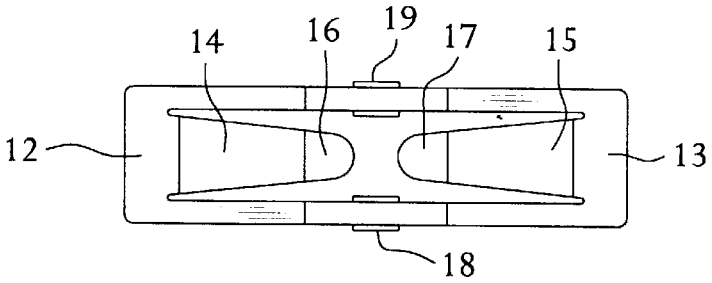
FIG. 4 is a top view of the bonnet clip of the invention.
Figure 5:
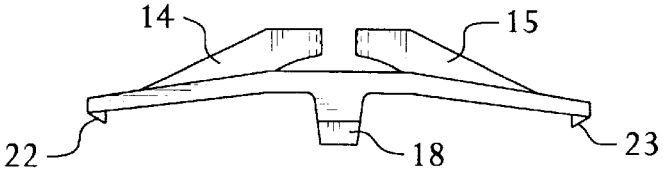
FIG. 5 is a side view of the bonnet clip of the invention.

Dust mop 1 of conventional configuration comprises handle 2 connected to mop head 3. Head 3 comprises base 4 which has a downwardly facing lower surface which rests within and is attached to support pad 5 by conventional means mop bonnet 6 which conventionally takes the form of a polishing or dusting cloth or similar fabric or cleaning surface, is adapted to overlay base 4 and pad 5 and extend onto and over the top of base 4. Side surfaces 7 and 8 of bonnet 6 are secured to base 4 by the novel bonnet attachment clips of the invention.

Attachment clips 9 are preferably of integral, unitary construction. Each clip is preferably a single plastic molded piece and it is anticipated that they are to be of identical configuration when used on a particular mop.

Clip 9 comprises base section 11 which forms the lower portion of the clip. Base section 11 has two side sections 12 and 13 which are adapted to overlay and secure side surfaces 7 and 8 of bonnet 6. Arm members 14 and 15 are integral and emanate from base section 11. Arms 14 and 15 terminate at ends 16 and 17. Ends 16 and 17 have upper surfaces which are configured for allowing the exertion of manual pressure on arms 14 and 15, respectively.

Clip 9 is secured at its midpoint to base 4 by dual attachment tabs 18 and 19, through base openings 20 and 21, which allow pivoted movement, up and down, of side sections 12 and 13. Tabs 22 and 23 rest within base openings 24 and 25 when there is no manual pressure being applied to clip 9.

Figure 6:
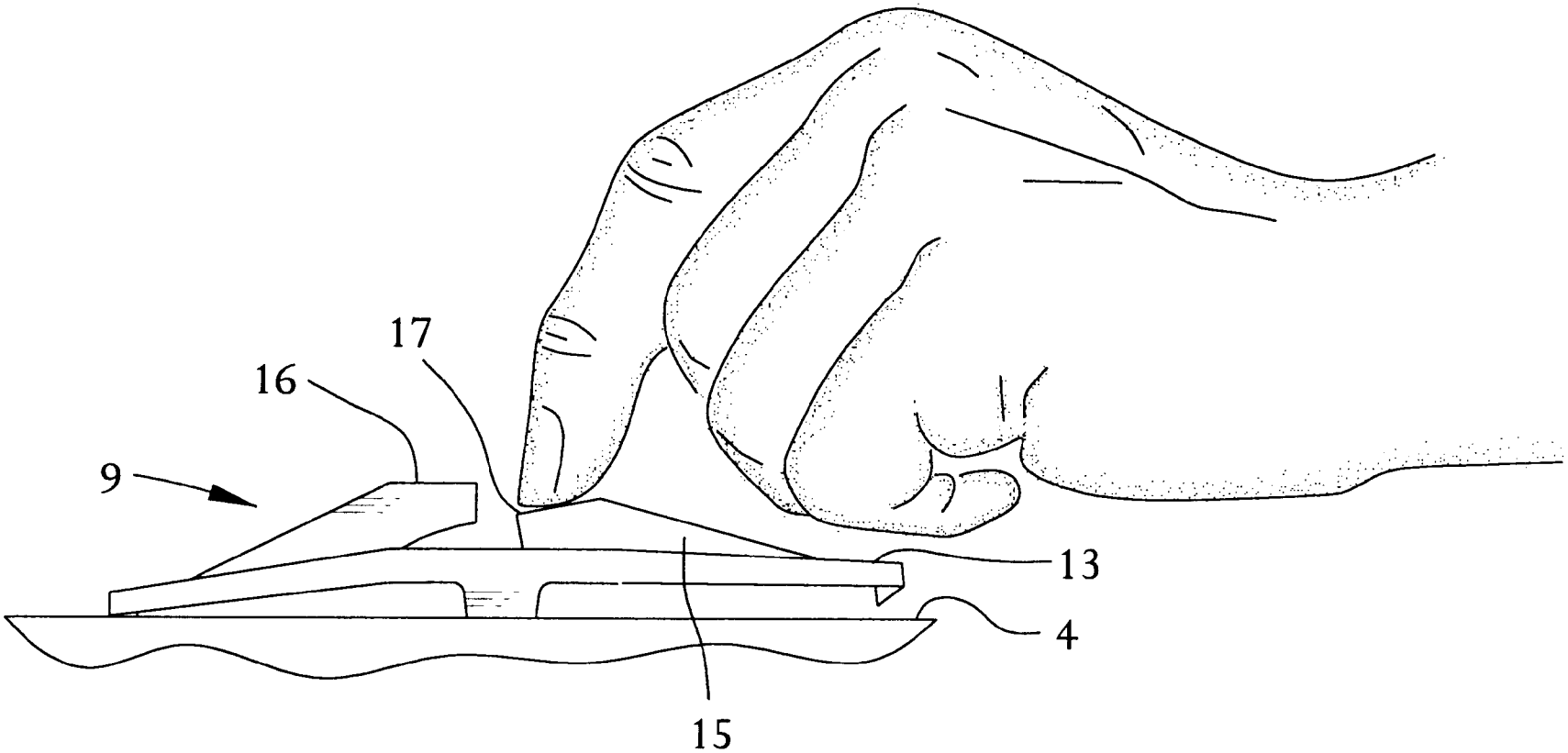
FIG. 6 is a side view showing the manner of usage of the bonnet clip of the invention.

When bonnet 6 is to be secured to base 4 and pad 5, it is positioned to surround the base and pad, with its side surfaces 7 and 8 extending over the top of base 4, as seen in FIG. 1. Ends 16 and 17 of clip 9 are pushed as shown in FIG. 6. Pushing down on end 17 of resilient arm 15, for example, pivots side section 13 up off base 4. Side surface 8 of bonnet 6 can then be positioned under side section 13, as seen in FIG. 1. When the manual push force is released from end 17, side section 13 pivots down, with tab 23 securely holding side surface 8 in place. Similar manual pushing action is then taken with end 16 and side section 12 of clip 9 to secure the other side surface 7 of bonnet 6. The second clip located on base 4 of mop 1 is then manually employed to secure the other end of bonnet 6.

Releasing bonnet 6 is accomplished simply by pushing down on ends 16 and 17 of clips 9. This raises side sections 12 and 13 of each clip, thereby allowing bonnet side surfaces 7 and 8 and thus bonnet 6 to be removed from base 4 and pad 5.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is a claim:

1. A mop with a handle connected to a base with a downwardly facing surface, a removable bonnet member adapted to overlay the downwardly facing surface of the base, bonnet attachment means located on the base, said attachment means comprising:

(a) resilient base attachment support means secured to the base, the support means having at least two side sections;

(b) dual resilient arm means upstanding from the support means, each arm means terminating at an end, whereby the application of manually applied pressure on an end pivots a side section upwards to allow insertion of the bonnet member between the side section and the base, whereby release of the pressure pivots the side section down to secure the bonnet member to the base.

2. The mop as in claim 1 in which the attachment means is an integral unitary piece.

3. The mop as in claim 2 in which the attachment means is molded plastic.

4. A mop as in claim 1 in which two attachment means, each with side sections, are located on the base.

5. A mop as in claim 1 in which the base attachment support means is secured to the base at the point at which it pivots upon the application of pressure on an end.

6. A mop as in claim 1 in which each side section of the attachment means secures opposite side surfaces of the bonnet member.

7. A mop as in claim 4 in which the side sections of the attachment means secure opposite side surfaces of the bonnet member.

* * * * *